US005704487A

United States Patent [19]

Taravella et al.

[11] Patent Number: 5,704,487

[45] Date of Patent: Jan. 6, 1998

[54] SHIPPING CONTAINER AND METHOD OF MAKING SAME

[75] Inventors: Philip Taravella, Grosse Pointe Shores; Ronald S. Domanski, St. Clair Shores, both of Mich.

[73] Assignee: Anchor Bay Packaging Corporation, New Baltimore, Mich.

[21] Appl. No.: 709,288

[22] Filed: Sep. 6, 1996

[51] Int. Cl.[6] ..... B65D 19/00

[52] U.S. Cl. ..... 206/596; 206/599; 108/51.3; 108/56.3

[58] Field of Search ..... 206/386, 596, 206/599; 108/51.3, 56.1, 56.3

[56] References Cited

U.S. PATENT DOCUMENTS

| | | | |
|---|---|---|---|
| 2,256,995 | 9/1941 | Andres . | |
| 2,611,569 | 9/1952 | Coleman et al. . | |
| 2,620,962 | 12/1952 | Powell . | |
| 2,997,266 | 8/1961 | Munroe . | |
| 3,000,603 | 9/1961 | Hemann . | |
| 3,041,029 | 6/1962 | Brown . | |
| 3,115,105 | 12/1963 | Allen . | |
| 3,131,656 | 5/1964 | Houle . | |
| 3,167,038 | 1/1965 | Brown . | |
| 3,425,544 | 2/1969 | Ayer et al. . | |
| 3,519,190 | 7/1970 | Achermann et al. | 108/51.3 |
| 3,675,345 | 7/1972 | Abrams . | |
| 3,708,861 | 1/1973 | Hickey | 206/386 |
| 3,949,874 | 4/1976 | Heavner | 206/596 |
| 4,134,533 | 1/1979 | Heavner . | |
| 4,485,922 | 12/1984 | Desmond et al. . | |
| 4,832,199 | 5/1989 | Rigby . | |
| 4,852,756 | 8/1989 | Holladay | 206/386 |
| 4,863,024 | 9/1989 | Booth | 108/51.3 |
| 4,976,353 | 12/1990 | Halliday | 206/386 |
| 5,121,838 | 6/1992 | Dickie . | |
| 5,222,444 | 6/1993 | Youell, Jr. et al. . | |
| 5,263,636 | 11/1993 | Aure . | |
| 5,295,632 | 3/1994 | Zink et al. . | |
| 5,339,746 | 8/1994 | Vannatta . | |
| 5,370,062 | 12/1994 | Johnston et al. | 108/51.3 |
| 5,441,154 | 8/1995 | Youell, III . | |
| 5,505,309 | 4/1996 | Taravella et al. . | |

FOREIGN PATENT DOCUMENTS

| | | | |
|---|---|---|---|
| 0576325A1 | 6/1993 | European Pat. Off. . | |
| 1.486.012 | 7/1966 | France . | |
| 2498564 | 7/1982 | France | 206/386 |

*Primary Examiner*—Paul T. Sewell
*Assistant Examiner*—Nhan T. Lam
*Attorney, Agent, or Firm*—Dykema Gossett PLLC

[57] ABSTRACT

The shipping container comprises a box made from a foldable material, and has a pair of side panels and a pair of end panels interposed between and connected to the side panels. The side and end panels are provided with upper and lower edges, with the lower edges of the side panels having connected thereto a pair of lower major closure flaps which are folded inwardly to cover the bottom of the box. A pallet is located in the interior of and at the bottom of the box. The pallet has first and second platforms, the lower major closure flaps overlie the second platform of the pallet. The lower edges of the end panels have connected thereto a pair of lower minor closure flaps which are folded towards one another and are spaced from the bottom of the box. The lower minor closure flaps overlie the first platform of the pallet. First fastening means are provided for securing the lower minor closure flaps to the first platform of the pallet. Second fastening means are provided for securing the lower major closure flaps to the second platform of the pallet, with the lower major and minor closure flaps holding and retaining the pallet in place in the bottom of the box.

12 Claims, 4 Drawing Sheets

SHIPPING CONTAINER AND METHOD OF MAKING SAME

FIELD OF THE INVENTION

The present invention relates to shipping containers made from foldable materials such as corrugated board, fiberboard, paperboard and plastic corrugated board and relates more particularly to shipping containers with integral pallets locked or trapped in the bottom of the containers, with the pallets being designed to receive the blades of conventional fork lift trucks.

BACKGROUND OF THE INVENTION

Containers and pallets used for the storage or transportation of a variety of goods such as automotive parts have been constructed out of wood or corrugated board or a combination thereof. Pallets have been made for many years completely out of wood and such pallets ordinarily are reused a number of times. Thereafter the wood pallets must be disposed in an acceptable manner. This disposal problem is magnified when automotive assembly plants are considered since thousands of the wood pallets must be disposed of in an acceptable manner. The wooden pallets are known to have a definite useful life and thereafter must be disposed of in an acceptable manner such as in land fills. Thus use of wooden pallets became an environmental issue as the amount of usable land fill space declined.

With the passage of laws or regulations prescribing against the disposal of wooden pallets in land fills, the industry is now using pallets fabricated of paperboard material such as corrugated board, fiberboard and the like. Such corrugated board products are considered to be more recyclable than wood. Such paperboard pallets and containers, in some cases, are deficient in areas including lateral stability and cost. Moreover, such paperboard pallet and containers must be capable of being moved by conventional fork lift trucks and to withstand the rugged forces which the containers encounter during use and shipment via railroad cars and trucks. Thus, there is a need to provide an industrial load supporting container with an integral pallet which has lateral stability and is capable of withstanding large loads.

U.S. Pat. No. 5,441,154, dated Aug. 15, 1995, issued to Donald R. Youell and discloses and claims an integrated paperboard container and pallet system having a paperboard pallet with an attached container. The container component of the system has upstanding walls which are spaced apart to form a generally polygonal shape interior cavity. At least one of the walls is formed as having at least one side tab extending downwardly therefrom. For forming the deck of the pallet component and the floor of the container component, a deck portion is provided as a generally planar member having an upper side forming a floor surface and a lower side forming a support surface. The planar member has edges forming a generally polygonal periphery and first openings therethrough for each side tab provided on the container. The pallet system further is formed of a first runner and a second runner, each of which, in turn, is formed as having a top wall. Each top wall of the runner is attached to the lower support surface of the deck portion for supporting the deck portion therebetween. It is also provided with a slot therethrough for and in registry with each corresponding first opening of the deck portion. For integrating the container and pallet components of the system, each side tab is received through a corresponding first opening of the deck portion and into the registered slot of a runner to attach the wall portion to the floor surface of the deck portion. Thus, the deck portion is only attached to the container portion via the tab and slot arrangements provided between the container and the pallet. Such containers are not always sturdy and do not provide the lateral stability required for transporting heavy loads. Thus, there is a possibility that the container when loaded can separate from the pallet in the event the tabs should break.

SUMMARY OF THE INVENTION

A feature of the present invention relates to a load bearing shipping container, carton or box provided with an integral pallet which is trapped in the bottom of the container between the pair of lower major closure flaps which are secured to the bottom of the pallet and a pair lower minor closure flaps which are secured to the top of the pallet.

A further feature of the present invention is to provide an integrated container and pallet system wherein the lower major and minor closure flaps are secured to the pallet by adhesives and by mechanical fasteners such as staples.

A still further feature of the present invention is to provide a method of making a container comprising the steps of forming a blank from a foldable material of generally uniform thickness, to provide a pair of side panels, a pair of end panels hingedly connected to opposite sides of the side panels, with the side and end panels having upper and lower edges, the lower edges of the side panels being located in a first plane and having a pair of lower major closure flaps, with the lower edges of the end panels being located in a second plane parallel to the first plane and having a pair of lower minor closure flaps.

Another feature of the present invention to provide a method which includes the steps of forming the blank into a box of generally rectangular configuration and thereafter turning the box upside down with the lower minor closure flaps extending horizontally and the lower major closure flaps extending vertically. Thereafter the method includes the further steps of applying adhesive to the upwardly facing lower minor closure flaps and inserting a pallet having a pair of generally flat platforms and being of generally rectangular configuration into the box with one platform of the pallet engaging the adhesive covered lower minor closure flaps. The method also includes the steps of applying adhesive to the other platform of the pallet and thereafter closing the lower major closure flaps against the adhesive covered platform. Further steps include applying a series of staples to secure the lower major closure flaps to the pallet and to thereafter turn the box upside down and applying a series of staples to secure the lower minor closure flaps to the pallet and thereby trap and secure the pallet between the lower major and minor closure flaps.

The final feature of the present invention is to provide an integrated container and pallet system which is simple in construction, economical to manufacture, easy to assemble, exhibits load bearing capabilities, provide lateral deflection strength and is easy to disassemble for recycling purposes.

IN THE DRAWINGS

DETAILED DESCRIPTION OF A PREFERRED EMBODIMENT

Figure 1:
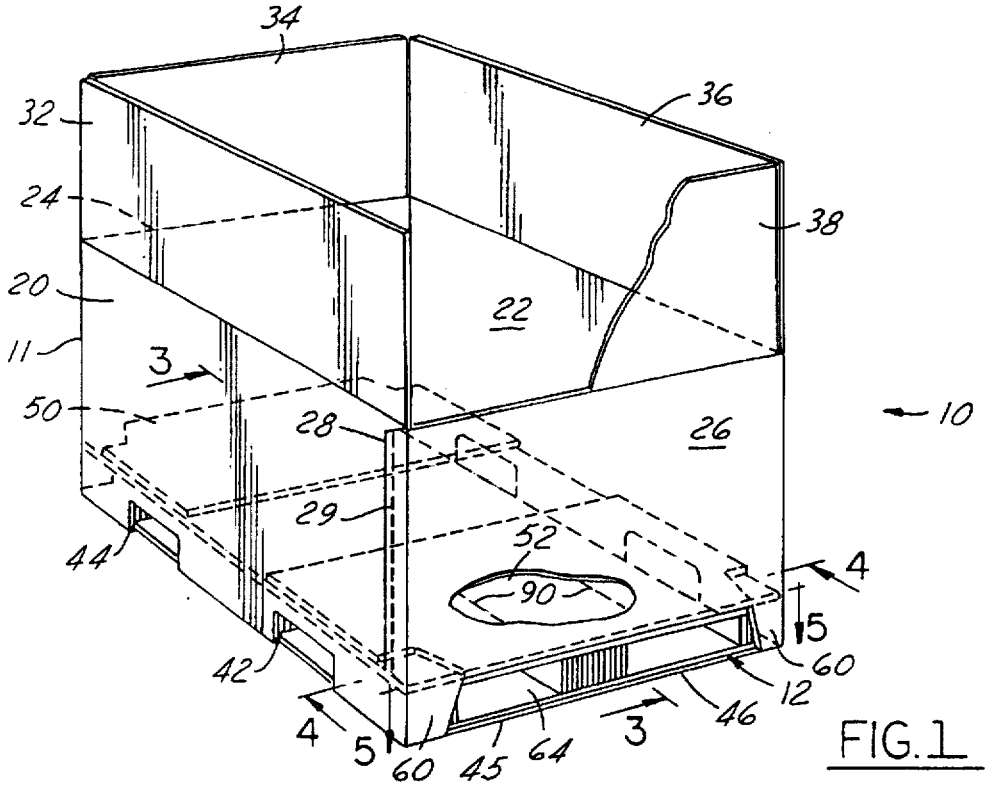
FIG. 1 is a perspective view of a shipping container, carton or box with a pallet trapped in the bottom of the shipping container between a pair of lower major closure flaps which underlie the bottom of the pallet and a pair of lower minor closure flaps which overlie the top of the pallet.
Figure 3:
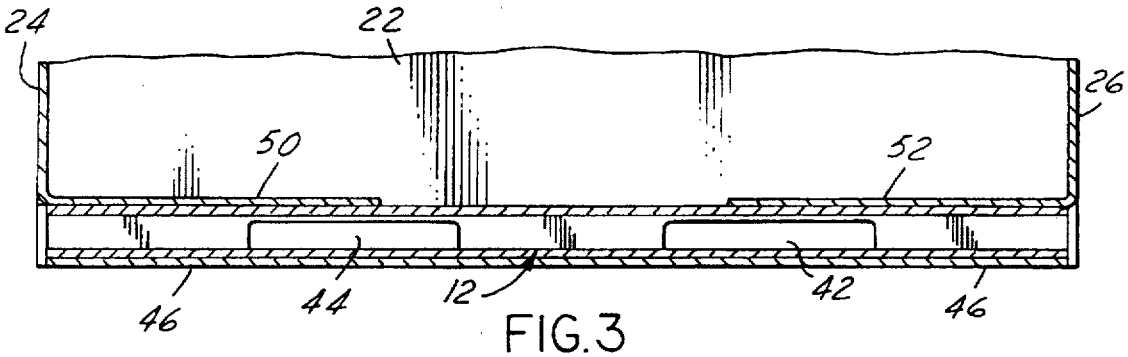
FIG. 3 is a fragmentary sectional view taken on the line 3—3 of FIG. 1.
Figure 4:
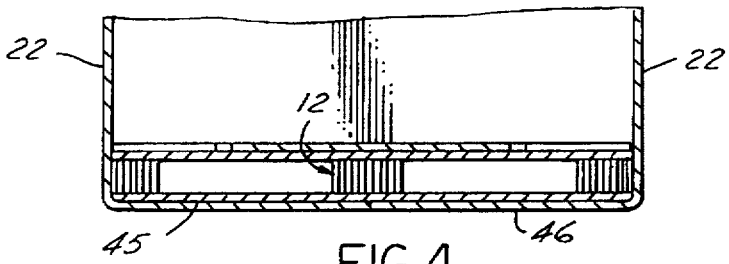
FIG. 4 is a fragmentary sectional view taken on the line 4—4 of FIG. 1.
Figure 6:
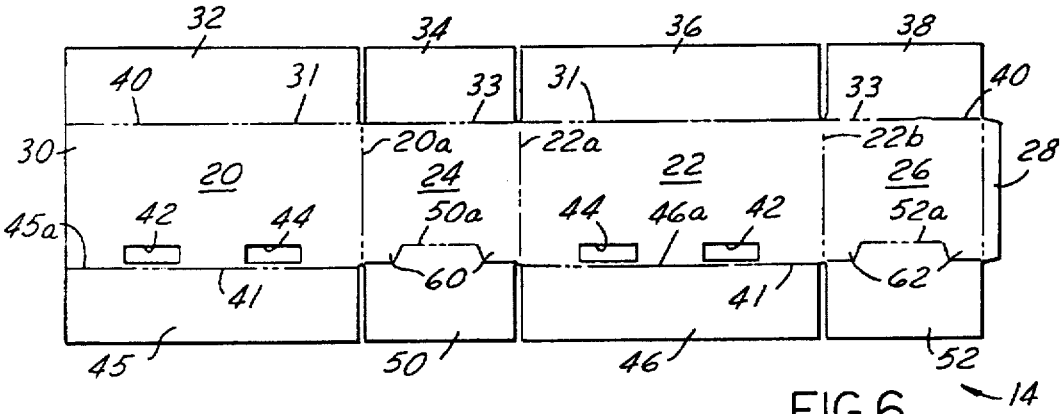
FIG. 6 is a plan view of a die cut container blank.

Referring now to the drawings, FIG. 1 illustrates an integrated container and pallet system 10 which comprises a carton or box 11 having at the bottom thereof a pallet 12. The canon or box 11 is made from a box blank 14, as shown in FIG. 6, of uniform thickness which is die cut or otherwise precut from foldable sheet material, as an example, corrugated board, fiberboard, paperboard or corrugated plastic sheet material.

The box blank 14 (FIG. 6) after removable from the die has a pair of side panels 20 and 22 and a pair of end panels 24 and 26. The end panel 24 is located intermediate the side panels 20 and 22 and is connected on opposite edges thereof by fold lines 20*a* and 22*a*. The other end panel 26 is connected to the side panel 22 by fold line 22*b*. The other edge of the end panel 26 is provided with an elongated side tab 28 which constitutes an extension of the end panel 26. When the box blank 14 is folded into a generally tubular configuration, the elongated tab 28 is stapled by means of a roll of staples 29 or is otherwise secured by adhesive to the edge portion 30 of the side panel as best illustrated in FIG. 1.

Referring once again to the box blank 14, the upper edges 31 of the side panels 20 and 22 are provided with a pair of upper major closure flaps 32 and 36. The upper edges 33 of the end panels 24 and 26 are provided with a pair of upper minor closure flaps 34 and 38. The upper major and minor closure flaps 32, 34, 36 and 38 are respectively connected to the corresponding upper edges of the side and end panels 20, 24, 22 and 26 by the fold line 40 as shown in FIG. 6.

As an optional feature of the present invention, it is not necessary to provide on the carton 11 the pairs of upper major and minor closure flaps 32, 34, 36 and 38. As an alternative, the integrated container and pallet system may have a separate top, cover or lid, not shown, provided with a peripheral flange or rim which will fit over the top edges 31 and 33 of the box 11 in order to close the interior thereof.

The box blank 14 further includes a pair of longitudinally spaced apart openings 42 and 44 adjacent the lower edge of each side panel 20 and 22. When the blank 14 is formed, the openings in panel 20 will be directly opposite the openings 42, 44 in panel 22. Each side panel 20 and 22 has a lower edge 41 to which are hingedly attached a pair of lower major closure flaps 45 and 46. Such major closure flaps 45 and 46 are foldable about fold lines 45*a* and 46*a* with respect to the side panels 20 and 22 respectively.

Figure 2:
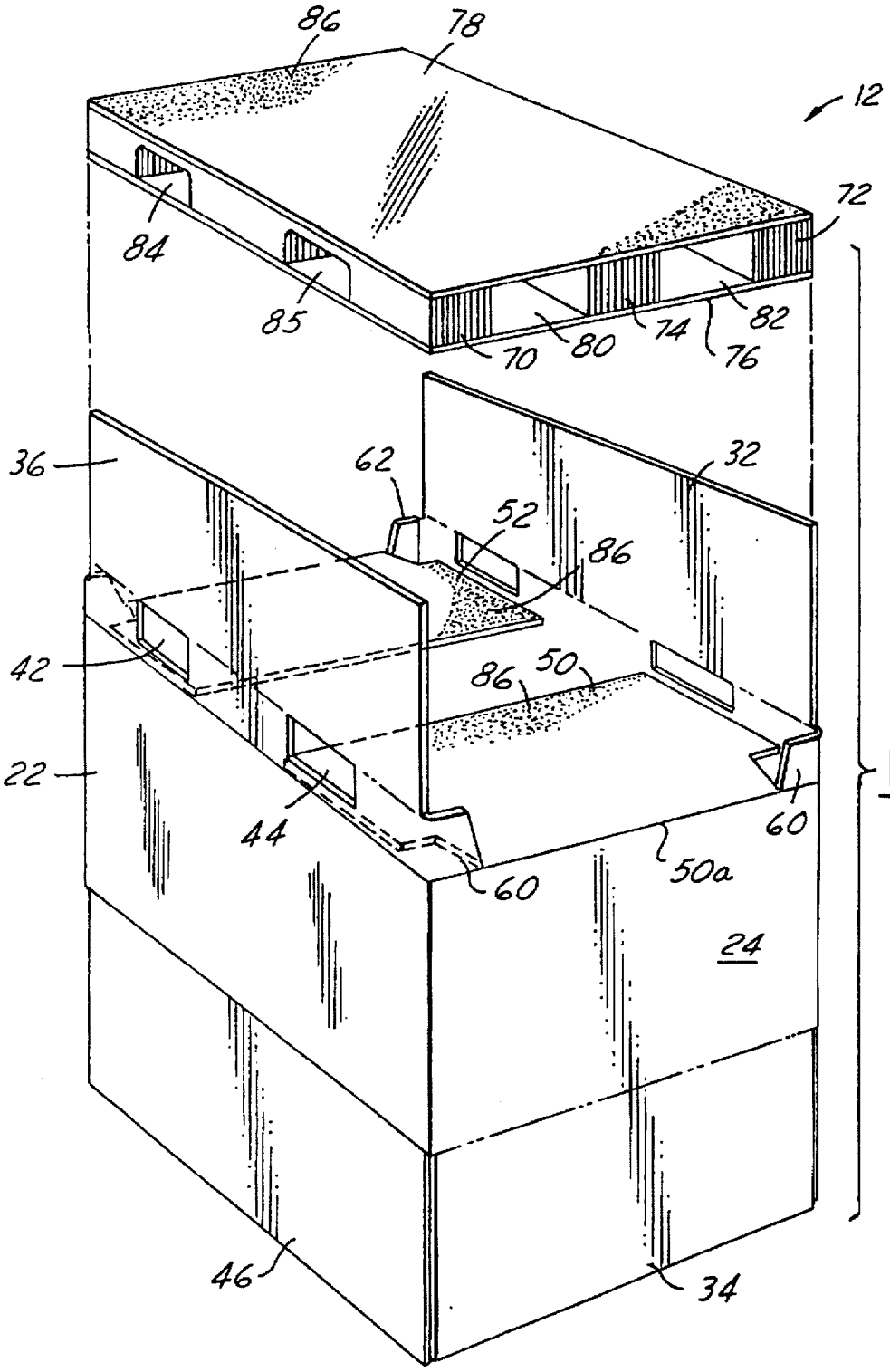
FIG. 2 is an exploded view showing the method of installing the pallet into the carton or box having the bottom facing upwardly.
Figure 5:
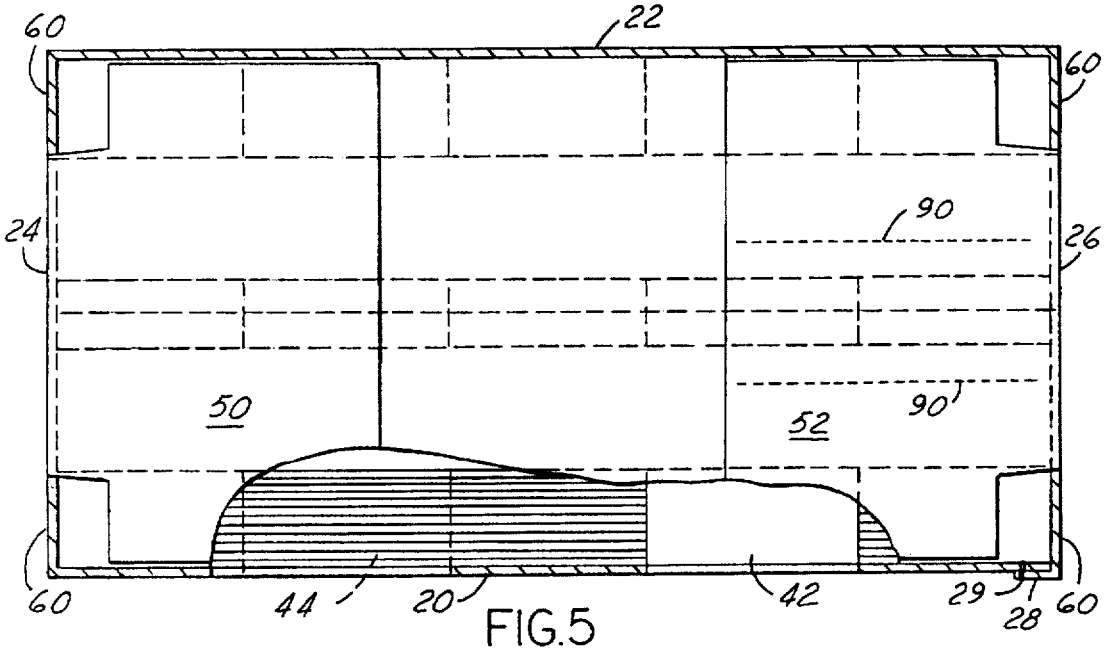
FIG. 5 is a section view of the container and pallet system taken on the line 5—5 of FIG. 1, with parts broken away.

The box blank 14 further includes a pair of lower minor closure flaps 50 and 52 which are hingedly connected to the end panels 24 and 26 respectively via the fold lines 50*a* and 52*a*. The lower minor closure flap 50 is separated from the end panel 24 except along the fold line 50*a*. In addition, the lower minor closure flap 52 is separated from the end panel 26 except for the fold line 52*a* as illustrated in FIGS. 1, 2 and 6. The manner in which the lower minor closure flaps 50 and 52 are attached to the end panels 24 and 26 results in a pair of lower corners 60 on end panel 24 and a pair of lower corners 62 on the end panel 26. The corners 60 are spaced apart to form an opening 64 in the end panel 24. In addition, the corners 62 are spaced apart so as to form a corresponding opening 64. The pallet 12 may be made entirely from corrugated board, fiberboard, paperboard or corrugated plastic sheet material or wood or any combination thereof.

The pallet 12 illustrated in FIGS. 1–5 inclusive includes a pair of end structural members 70 and 72 and an intermediate structural member 74. The structural members 70, 72 and 74 are parallel and are sandwiched between a first platform or deck 76 and a second platform or deck 78. The structural members 70, 72 and 74 may be made according to the method and structure disclosed in U.S. Pat. No. 5,531,165 of Jul. 2, 1996, assigned to the assignee of record. The component parts of pallet 12 are made from corrugated or fiberboard or other suitable material which is capable of being formed and attached as illustrated. The structural members 70, 72 and 74 are spaced from one another to form with the panels or platforms 76 and 78 a pair of straight through passages or passageways 80 and 82 (FIG. 2) which extend from one end of the pallet 12 to the other end. Each structural member 70, 72 and 74 has a pair of transverse openings 84 and 85 (FIG. 2) which are aligned with corresponding openings in the other structural members to form passages or passageways which extend from one side of the pallet to the other side. A first pair of passageways are perpendicular to the other pair of passageways. Each pair of passageways are arranged to receive the blades or tangs of a fork lift truck. The pairs of passages in the pallet 12 are lined with the openings provided in the bottom of the carton as shown in FIG. 1.

Referring now to FIG. 6, the die cut blank 14 is formed into a generally rectangular form with the tab 28 provided on the end panel 26 engaging and being secured to the edge 30 of the side panel 20 by a series of staples 29 (FIG. 1 ). After the box 11 is formed, it is turned upsidedown as shown in FIG. 2, with the pair of lower major closure flaps 32 and 36 extending upwardly and the pair of lower minor closure flaps 50 and 52 extending horizontally and folded about their respective fold lines 50*a* and 52*a*. The method also contemplates the application of an adhesive 86 to the upwardly facing surfaces of the lower minor closure flaps 50 and 52. The method further contemplates the step of taking the platform 12 and placing it in the bottom of the box by placing it in the corners 60 and 62 of the box so that the first platform 76 of the pallet 12 engages the adhesive covered surfaces of the lower minor closure flaps 50 and 52.

The method also contemplates the step of applying adhesive 86 to the second platform 78 of the pallet 12. Thereafter the method employs the steps of folding the lower major closure flaps 32 and 36 about their respective fold lines so as to secure the flaps to the adhesive coated or covered platform 78 of the pallet 12. The next step contemplates applying a series of staples to the lower major closure flaps 32 and 36 to further secure the flaps to the platform 78 of the pallet 12. Once the stapling operation has been completed, the container 11 is reversed so that the platform 12 of the container and pallet system 10 is at the bottom as shown in FIG. 1. The next step contemplates the application of a series of staples 90 to secure the lower minor closure flaps 50 and 52 to the first platform 76 of the pallet 12 thereby completing the method steps. It should be noted that the openings 42 and 44 provided in the side panels 20 and 22 are aligned with the pair of passageways 84 and 85 provided in the pallet 12 which are formed in part by the openings provided in the structural members 70, 72 and 74. In addition, the openings 64 provided in the end panels 24 and 26 are also in line with the spaces provided between the laterally spaced apart structural members 70, 72 and 74. The longitudinally and transversely extending passageways provided in the pallet 12 of the container system 10 permit the blades of a fork lift truck to be inserted either from the side or from the end of the container.

Figure 7:
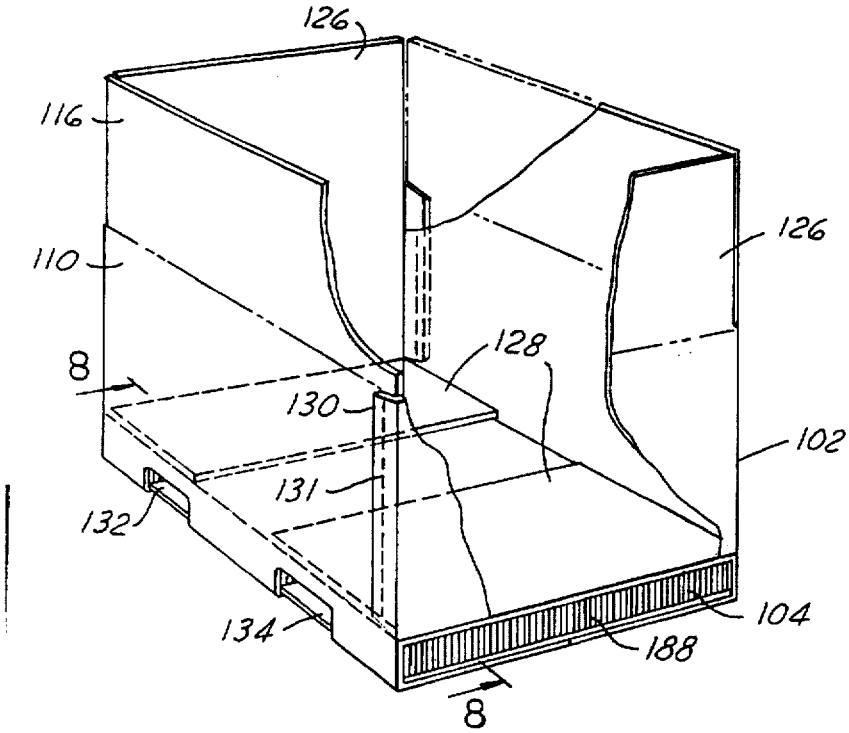
FIG. 7 is a perspective view of an other embodiment of the present invention with the pallet installed in the bottom of the container, with a pair of lower minor closure flaps overlying the top of the pallet to trap the pallet in the bottom of the container against the pair of lower major closure flags.
Figure 8:
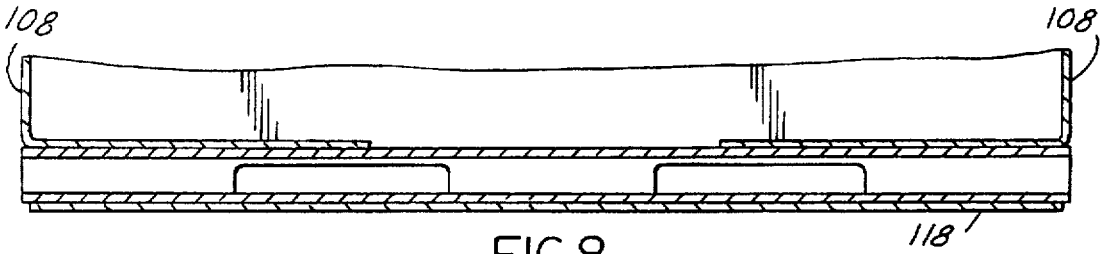
FIG. 8 is a fragmentary sectional view taken on the line 8—8 of FIG. 7.
Figure 9:
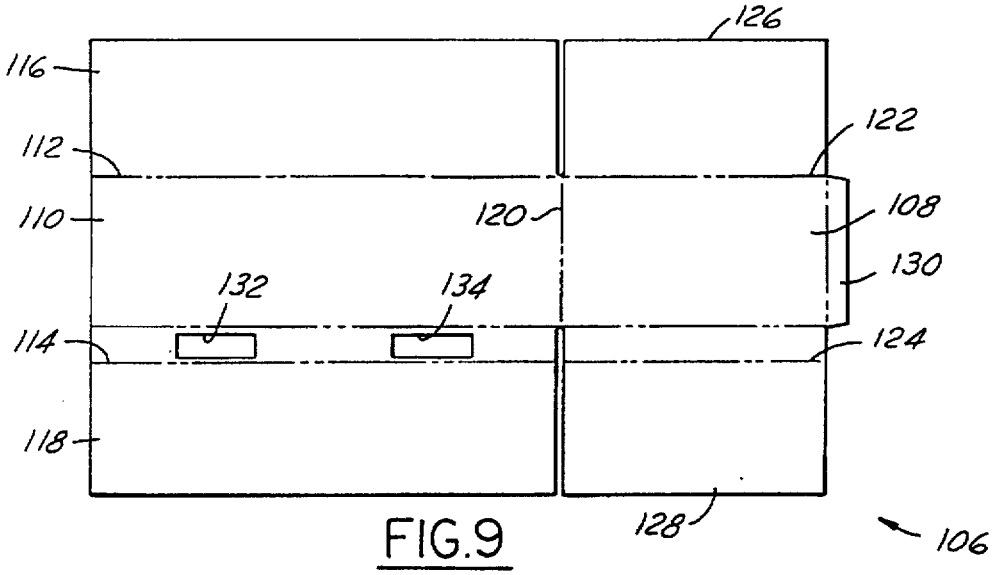
FIG. 9 is a plan view of a die cut blank, with two blanks required to make the shipping container of FIG. 7.

Referring now to the embodiment illustrated in FIG. 7–9 inclusive, the integrated container and pallet system is designated by the numeral 100. It includes a container 102 having a pallet 104 located in the bottom of the container 102. The container 102 is made from two die cut pieces or blanks, one piece being shown in FIG. 9 and designated by the numeral 106. Each die cut blank 106 includes an end panel 108 and a side panel 110. The side panel 110 has an upper edge 112 and a lower edge 114 to which are respectively connected an upper major closure flap 116 and a lower major closure flap 118 respectively. The edges 112 and 114 form fold lines for the panels 116 and 118. The end panel 108 is hingedly connected to an edge of the side panel at the fold line 120. The end panel 108 has an upper edge 122 and a lower edge 124 which form fold lines for attaching respectively the upper minor closure flap 126 and the lower minor closure flap 128 respectively. The end panel 108 has an extension or tab 130. In addition the side panel 110 is provided with a pair of openings 132 and 134 which are aligned with corresponding passageways provided in the pallet to receive the blades of fork lift truck.

In practicing the method of the present invention, two box blanks 106 are formed into the configuration illustrated in FIG. 7 whereby tab 130 of each blank 106 engages an edge of the adjacent side panel 110 and is secured thereto by a series of staples 131. Once the blanks 106 are formed into a tubular configuration as shown in FIG. 2, the method steps defined previously are followed to make the integrated container and pallet system 100.

The pallet 104 is made from a series of laminated corrugated strips which are suitably notched to provide openings which form a pair of passageways in the pallet 104. The passageways extend from one side 110 to the other side 110 of the carton 102 and receive the blades of a fork lift truck. No openings are provided in the end panels 188 as were described for the embodiment of FIG. 1.

It should be appreciated that various types of pallet structures may be used which the disclosed integrated container and pallet systems. In addition, various pallets may be used in practicing the method disclosed and claimed in the present invention.

Figure 10:
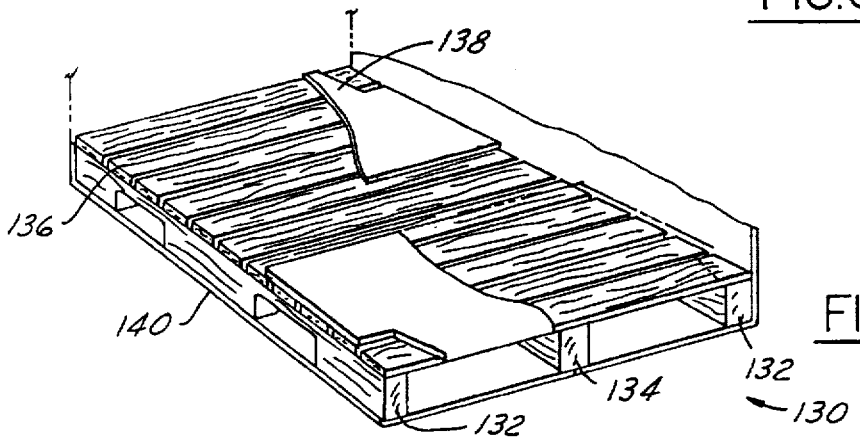
FIG. 10 is a perspective view of a pallet made from wood which can be used in either of the embodiments of FIGS. 1 and 7 in place of the corrugated board pallets.

As an example, FIG. 10 discloses a wood pallet 130 having a pair of elongated structural members 132 separated by an intermediate structural member 134. The structural members 132 and 134 are tied together at the top by a plurality of transversely extending cross members 136. The cross members 136 are covered by a top platform 138. A lower platform 140 is also provided. The platforms 138 and 140 may be made from plywood or corrugated board or any other suitable material. The platforms 138 and 140 are secured to the structural members 132 and 134 by appropriate fastening means such as nails or staples.

A pallet and structural members therefor for use in the integrated container and pallet system of the present invention are more fully disclosed and described in U.S. Pat. No. 5,531,165 of Jul. 2, 1996, assigned to the assignee of record, the disclosure of which has been expressly incorporated herein by reference.

What we claim is:

1. A shipping container comprising a box made from a foldable material, said box having a pair of side panels, a pair of end panels interposed between and connected to said side panels, said side and end panels having upper and lower edges, the lower edges of said side panels having connected thereto a pair of lower major closure flaps which are folded inwardly to cover the bottom of said box, a pallet located in the interior of and at the bottom of said box, said pallet having first and second platforms, said lower major closure flaps overlying the second platform of said pallet, the lower edges of said ends panels having connected thereto a pair of lower minor closure flaps which are folded towards one another and are spaced from the bottom of said box, said lower minor closure flaps overlying the first platform of said pallet, first fastening means for securing said lower minor closure flaps to the first platform of said pallet, second fastening means for securing said lower major closure flaps to the second platform of said pallet, said major and minor flaps holding and retaining said pallet in place in the bottom of said box, each of said side panels near said lower edges is provided with a pair of laterally extending openings, with the openings in one side panel being aligned with the openings in the other side panel, said pallet having a pair of passageways therein, with each passageway aligned with a pair of aligned openings in said side panels, said aligned passageways and openings adapted to receive the blades of a fork lift truck.

2. The shipping container defined in claim 1, wherein said foldable material is taken from the group comprising corrugated board, fiberboard, paperboard and plastic corrugated board.

3. The shipping container defined in claim 1, wherein the upper edges of said side panels have connected thereto a pair of upper major closure flaps, the upper edges of said end panels have connected thereto a pair of upper minor closure flaps, said upper major and minor closure flaps being foldable inwardly to cover the interior of said box.

4. The shipping container defined in claim 1, wherein a separate cover including a peripheral flange portion surrounds the upper edges of said side and end panel and closes the interior of said box.

5. The shipping container defined in claim 1, wherein said pallet has a plurality of longitudinally spaced apart structural members between and secured to said platforms, said structural members extending parallel to said side panels, each structural member having a pair of slots therein aligned with the slots in the other structural member and forming part of said passageways which are aligned with the openings in said side panels to receive the blades of a fork lift truck.

6. The shipping container defined in claim 5, wherein said structural members are made from a material taken from the group comprising corrugated board, fiberboard, paperboard and plastic corrugated board.

7. The shipping container defined in claim 5, wherein said structural members are made from wood.

8. The shipping container defined in claim 1, wherein said end panels below said lower edges are notched except at the corners to expose the spaces between said structural members, said spaces adapted to receive the blades of a fork lift truck.

9. The shipping container defined in claim 8, wherein said first fastening means is an adhesive for securing said lower minor closure flaps to the first platform of said pallet.

10. The shipping container defined in claim 9, wherein said second fastening means is an adhesive for securing said lower major closure flaps to the second platform of said pallet.

11. The shipping container defined in claim 10, wherein said second fastening means include a series of staples between said lower major closure flaps and the second platform of said pallet.

12. The shipping container defined in claim 9, wherein said first fastening means include a series of staples between said lower minor closure flaps and the first platform of said pallet.

* * * * *